US007052602B2

(12) United States Patent
Boggs et al.

(10) Patent No.: US 7,052,602 B2
(45) Date of Patent: May 30, 2006

(54) SKIMMER INTAKE GUARD—FOR A SWIMMING POOL OR HOT TUB

(76) Inventors: Karen L. Boggs, 1665 Fairway Crest, Loveland, OH (US) 45140; Gary L. Boggs, 1665 Fairway Crest, Loveland, OH (US) 45140

( * ) Notice: Subject to any disclaimer, the term of this patent is extended or adjusted under 35 U.S.C. 154(b) by 19 days.

(21) Appl. No.: 10/810,287

(22) Filed: Mar. 27, 2004

(65) Prior Publication Data

US 2005/0211614 A1 Sep. 29, 2005

(51) Int. Cl.
*E04H 4/12* (2006.01)

(52) U.S. Cl. ..... 210/169; 210/232; 210/416.2; 210/459; 4/496; 4/507

(58) Field of Classification Search ..... 210/169, 210/232, 416.1, 416.2, 459, 460, 462, 463; 4/496, 504, 506, 507
See application file for complete search history.

(56) References Cited

U.S. PATENT DOCUMENTS

| | | | | |
|---|---|---|---|---|
| 4,140,634 | A * | 2/1979 | Harry | 210/169 |
| 4,429,429 | A * | 2/1984 | Altschul | 15/50.1 |
| 5,128,034 | A * | 7/1992 | Kool | 210/232 |
| 5,935,450 | A * | 8/1999 | Benedict | 210/776 |
| 6,214,217 | B1 * | 4/2001 | Sliger, Jr. | 210/169 |
| 6,716,342 | B1 * | 4/2004 | Tilsner | 210/169 |
| 6,760,931 | B1 * | 7/2004 | Mattson et al. | 4/541.1 |
| 6,817,041 | B1 * | 11/2004 | Evans et al. | 4/496 |
| 2005/0055898 | A1 * | 3/2005 | Georgeff et al. | 52/169.6 |

* cited by examiner

*Primary Examiner*—Fred G. Prince

(57) ABSTRACT

A flat shaped skimmer intake guard having hooks for attachment of the guard to the water intake to prevent intake from becoming blocked by medium and large toys, floatation devices, noodles, other pool accessories and man-made devices floating in the swimming pool or the like.

4 Claims, 2 Drawing Sheets

SKIMMER INTAKE GUARD—FOR A SWIMMING POOL OR HOT TUB

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention relates to a filter skimmer intake guard, and in particular to a guard for the skimmer opening for swimming pools or hot tubs, which mounted on the walls of the pool to prevent the accidental blockage of the skimmer opening and/or pipe behind the intake. Further, the field of this skimmer intake guard invention relates to one that is simple for installation, economical, does not inhibit the use of the pool or tub and can, but does not ever need to be removed for cleaning, maintenance or winterization.

The modern day swimming pool faces an ever-changing amount of use and operating conditions. There are increasing amounts and types of pool accessories, toys, floatation devices and other man made objects available and in use in pools today.

An ongoing problem is the frequency in which these toys and floatation devices enter the skimmer. Because a pool filter is continuously running, eventually all pool water is pumped through the skimmer opening, it is difficult to prevent blockage of skimmer intake opening.

One of the shortcomings of the current skimmer opening is that larger items often enter the skimmer intake and become trapped in the filter basket. This can reduce the efficiency of the pump and filtration system, but can also cause the pool pump(s) to cavitate and possibly fail or burn out.

Previous skimmer screens have addressed the collection of leaves and debris from the skimmer, but all of these devices utilize a device that is attached the pool or skimmer and intrudes into the pool, becoming a hazard to swimmers, or needs to be removed while swimming.

A market exists for a skimmer intake guard that is easily attached, economically simple, does not inhibit use of the pool or create safety hazards, when installed.

DESCRIPTION OF THE PRIOR ART

There have been many prior attempts to create deflectors, screens, and shields, which primarily are intended to collect leaves, twigs and other debris, and increase the effectiveness of filtering. Many of these devices attach permanently to the pool, intrude upon the swimming area, and create safety hazards. Those attempts have many shortcomings for limiting pool use, maintenance and pool and/or deck safety.

In U.S. Pat. No. 3,314,543 to Nash a pool skimmer system is disclosed which incorporates screen cages which are mounted beneath the deck of the pool in line with the skimmer openings and above the trough associated with the skimmer system. The cages are provided to prevent debris from entering the filters.

Unfortunately, these cages are placed within the intake openings where they are difficult to access, and still allow large floatation devices to enter the skimmer opening and prevent water flow to the pumps.

In U.S. Pat. No. 4,140,634 to Harry, a swimming pool skimmer shield is disclosed which is designed to be mounted to the side walls of a pool. The patent discloses the use of hooks or fasteners, which are driven into the sidewalls of the poll on opposite sides of the skimmer openings. Thereafter a nylon mesh fabric with 3/16" diameter holes is suspended so as to extend across the full width of a skimmer intake opening to block and catch debris at the opening. Unfortunately, the structure disclosed in this patent requires that fasteners be utilized to secure the shields to the sidewall of the pool. It is neither practical nor desirable to compromise the integrity of the sidewalls of the pool by driving fasteners into the walls adjacent the intake openings. Further, the screen is positioned in the pool area providing a safety hazard for swimmers.

In U.S. Pat. No. 5,935,450 to Benedict, pool skimmer screens is disclosed which incorporates a screen cage which covers the intake and is frictionally engaged on the sidewalls of the intake or are hooked over the weir hinge pins inside the intake. In general, this patent discloses the mesh size to allow for minimum resistance to fluid flow and provide for maximum retention of debris. The patent discloses the primary objections to be the screening devices for preventing debris from entering the intake opening of the pool filter or skimmer system.

In U.S. Pat. No. 6,241,217 to Sliger, Jr., a skimmer screen for a swimming pool is disclosed which incorporates a rounded screen cage, which covers the intake and securely mounted to the sidewall of the intake. In general, this patent discloses a new skimmer screen of rounded fashion, with a screen mesh. The patent discloses the primary objections to be the screening devices for preventing debris and other objects from entering the intake opening of the pool filter or skimmer system.

In general, the above listed patents have only a limited relevance. These devices have been developed for the prevention and collection of debris and leaves. They each are intended to collect debris and should not be used while swimming, as they would be a safety hazard. They each use a mesh or screen of some type of material, configured in a cage or box design, which attaches in some fashion to the intake, and protrudes into the pool.

The advantage of our device over the aforementioned body of prior art is significant it prevents medium and large toys, floatation devices, noodles, other pool accessories and man-made devices, made from plastic or foam material, which easily enters the filter intake, when the above prior art is removed for swimming. The filter guard can stay in place during swimming and does not protrude into the pool. In addition, it does not prevent the installation or use of many of the debris collection devices listed above.

In view of the foregoing, there still remains the need for a new skimmer intake guard to prevent medium and large toys, floatation devices and other pool accessories from entering the skimmer, while not modifying the pool or encroaching upon the swimming area, which can be safely used year round.

BRIEF SUMMARY OF THE INVENTION

The general purpose of the skimmer intake guard is to provide not a screen, but a new guard, which can be used while swimming in the pool, and will not be a hazard to those swimming. These advantages of the skimmer intake guard provide a new guard, which has not been anticipated, suggested or implied by any of the prior art swimming pool screens, either alone or in any combination thereof.

To attain this, the present invention generally comprises of a grid system of injected molded plastic or equivalent, that is molded to a frame that snaps over the intake frame, and is held in place by up to four (4) integrally molded hooks.

The grid system is one of multiple possible designs, being square, rectangular, triangular or any combination thereof. The openings of the grid system are large enough to allow leaves and debris to pass, but small enough to prevent medium and large toys, floatation devices, noodles, other pool accessories and man-made devices, from entering and blocking the intake.

The skimmer intake guard can be made to fit any variety of size or shape of filter intake openings.

The primary object of the invention is to provide a guard for preventing medium and large toys, floatation devices, noodles, other pool accessories and man-made devices, from entering the filter intake.

An object of the invention is to increase the efficiency of circulation systems for swimming pools or the like.

A further object of the invention is to provide apparatus for use in a swimming pool or the like for guarding the skimmer intake from medium and large toys, floatation devices, noodles, other pool accessories and man-made devices, while not restricting pool use, or inhibiting safety.

A still further object of the invention is to provide apparatus for use in a swimming pool or the like for shielding the skimmer mouth and protecting the water filtration system from medium and large toys, floatation devices, noodles, other pool accessories and man-made devices, which is economical in construction and simple in operation.

Still yet another object of the present invention is to provide a new skimmer intake guard for a swimming pool that can be conveniently and unobtrusively mounted over the skimmer intake of a swimming pool, and does not inhibit use of the swimming pool.

It is a further object of the present invention to provide a new skimmer intake guard for a swimming pool, which is of a durable and reliable construction.

An even further object of the present invention is to provide a new skimmer intake guard for a swimming pool, which has a low cost of manufacture with regard to both materials and labor, and which has a lower price of sale for the consuming public, and simple enough installation, as to make such skimmer intake guard for a swimming pool economically available to the buying public.

DETAILED DESCRIPTION OF THE INVENTION

Figure 1:
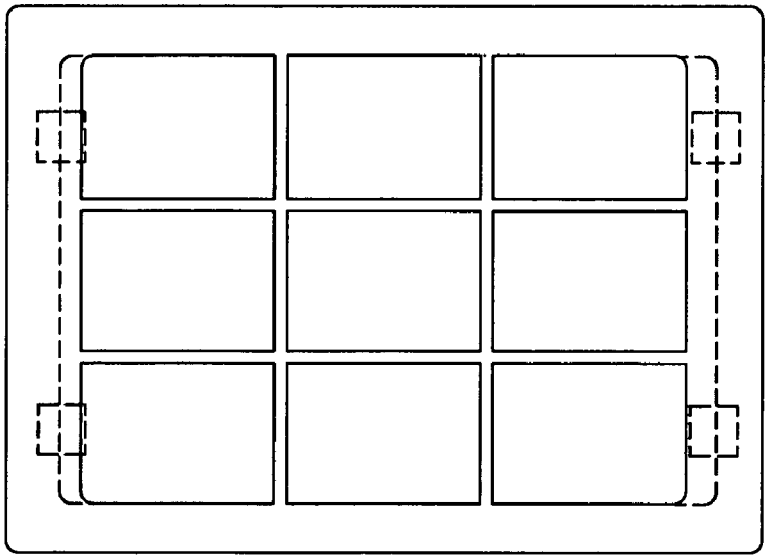
FIG. 1 shows front elevation view of the skimmer intake guard.
Figure 2:
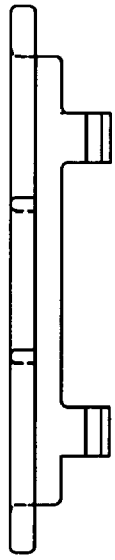
FIG. 2 is a side elevation view of the skimmer intake guard of FIG. 1.
Figure 3:
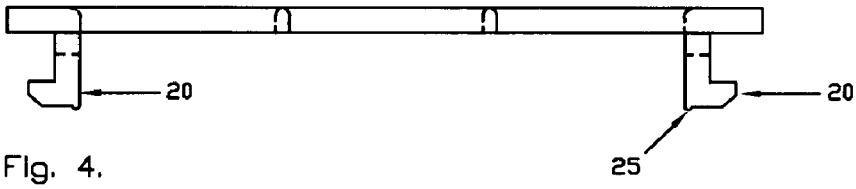
FIG. 3 is a top elevation view of the skimmer intake guard of FIG. 1.

Referring to the drawings, and in particular to FIGS. 1 through 4, the skimmer intake guard is preferably made of a white, semi-rigid plastic material, or the like. The skimmer intake guard is manufactured by an injection molding process, or equivalent thermal forming process. The injection molding process provides for a single piece skimmer intake guard, which can be easily installed. This is a vast improvement over prior art screen designs, that required multiple pieces, assembly and complex installation.

The skimmer intake guard 10 is constructed in such that the guard face is slightly larger in size that the intake opening, and of similar thickness. The guard face is a rectangle shape, same as the intake opening. On the vertical sides of the skimmer intake guard, are two (2) molded snap hooks 20, which protrude 90 degrees from the face of the guard, into the skimmer intake. The hooks snap on the inside of the skimmer intake and hold it in place. On the back of the hook, is a small detent 25, which allows the guard hooks to be released and the guard can be removed.

Figure 4:
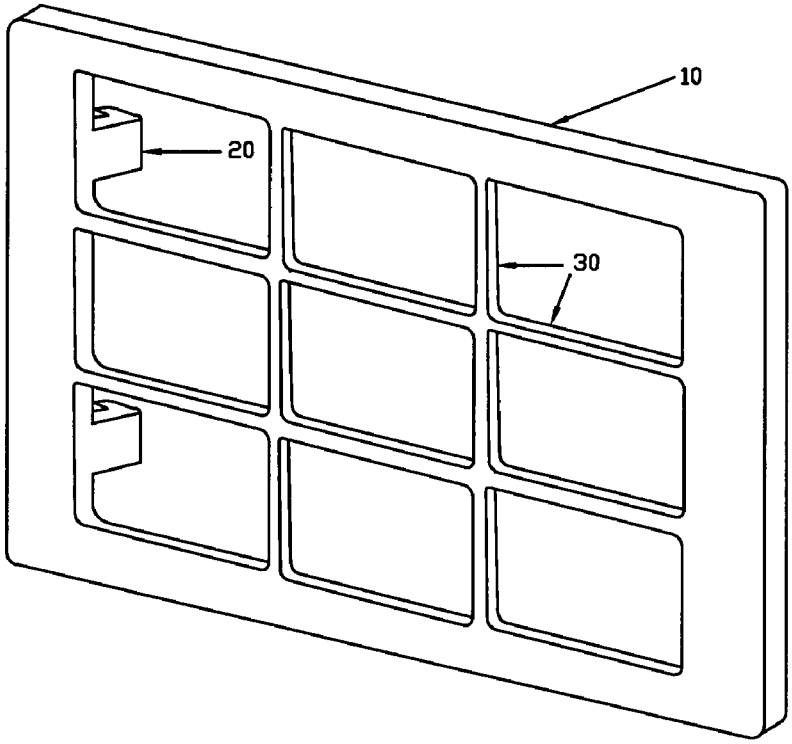
FIG. 4 is a perspective view of the skimmer intake guard of FIG. 1.
Figure 5:
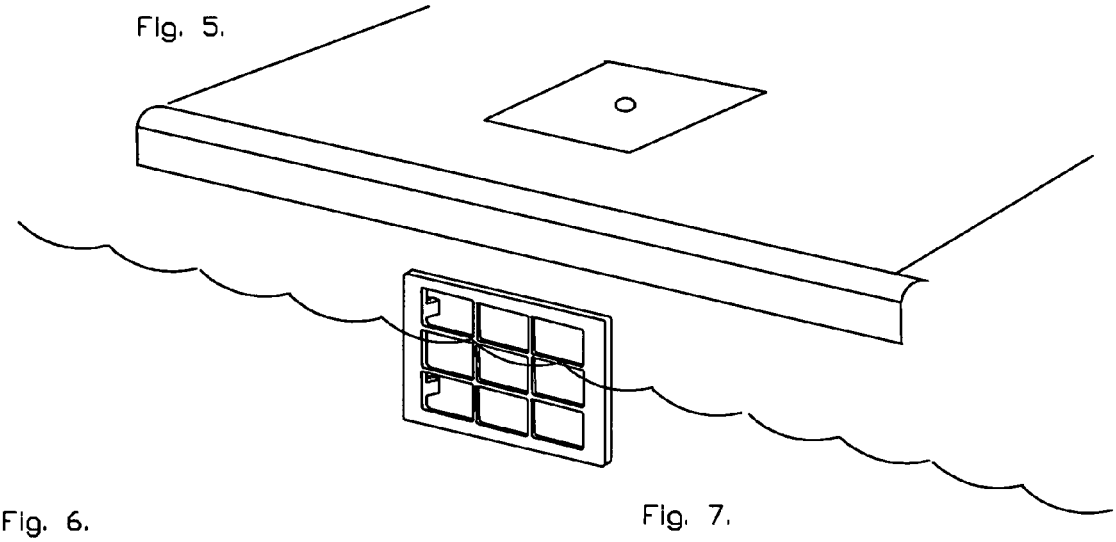
FIG. 5 is a perspective view of swimming pool filter intake with the invention present.
Figure 6:
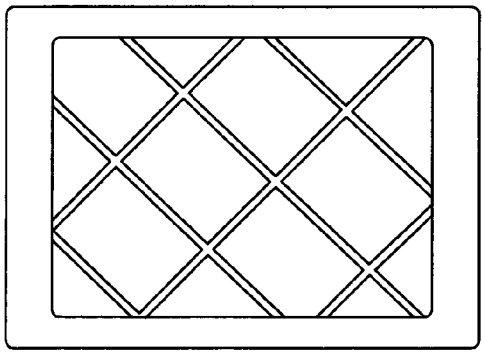
FIG. 6 shows a diagonal grid pattern for the skimmer intake guard for FIG. 1.
Figure 7:
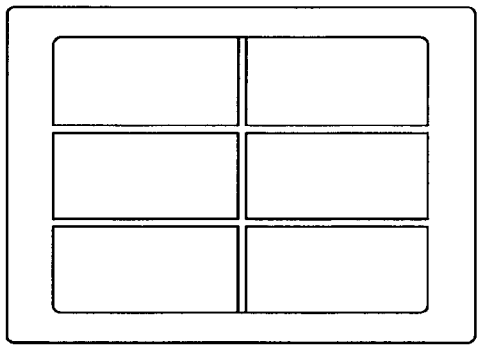
FIG. 7 shows a rectangular grid pattern for the skimmer intake guard for FIG. 1.

From the top and bottom, left and right frame, small diameter cross members or bars 30 are molded in such a way as to create a pattern, either square FIG. 4., diagonal FIG. 6. or rectangular FIG. 7. across the face of the frame, thus creating the guard.

This cross pattern of plastic prevent medium and large toys, floatation devices, noodles, other pool accessories and man-made devices from entering the skimmer. In additions, by blocking the items prior to entering the skimmer, these items are visual noticeable and indicate the action is required to clear the items.

We claim:

1. A skimmer intake guard for use in a pool or tub with a skimmer intake opening, and used to provide a guard between the pool and the pool skimmer intake opening comprising of:

a rectangular-shaped, semi-rigid member having a rectangular section, which is to be dimensioned like that of the skimmer intake, consisting of upper and lower horizontal bars, and first and second vertical bars, which make up the rectangular-shaped, semi-rigid member; where the vertical bars are connected to the horizontal bars at each end, thus comprising a rectangular frame or flange which will bear against the skimmer intake; and;

a first round-shaped, semi-rigid cross-member running parallel to the upper horizontal bar and a second round-shaped semi-rigid cross-member running parallel to the first cross-member;

wherein each cross-member is spaced an equal distance from each other and the horizontal bars of the rectangular frame, and;

a third round-shaped, semi-rigid cross member running perpendicular to the first semi-rigid cross-member and running parallel to the vertical bars of the rectangular frame, and a fourth semi-rigid cross-member running parallel to the third cross-member;

where each cross-member is spaced an equal distance from each other and the vertical bars of the rectangular frame, thus creating a grid shape of equal proportions.

2. A skimmer intake guard for use in a pool or tub as described in claim 1, wherein the guard has up to four (4) hooks for attaching guard to the skimmer intake, and;

a first hook member formed along the first vertical bar of the rectangular flange, in a distal end of the first vertical bar, formed at 90 degrees, consisting of a hook, so as to fit securely inside the skimmer intake opening, and;

said hook, in combination with the rectangular flange fits securely on the face, inside wall, and inside rear lace of the skimmer intake opening, and;

said hook, varies in length to accommodate the dimensions of various skimmer intakes, and;

a second hook member formed at an equal distance from the first hook on the first vertical bar of the rectangular flange, formed at 90 degrees, consisting of a hook, so as to fit securely inside the skimmer intake opening, and;

a third hook member formed on the opposite side, on the second vertical bar of the rectangular flange, in a distal end of the second vertical bar, formed at 90 degrees, consisting of a hook, so as to fit securely inside the skimmer intake opening, and;

a fourth hook member formed an equal distance from the third hook on the same vertical bar of the rectangular flange, formed at 90 degrees, consisting of a hook, so as to fit securely inside the skimmer intake opening.

3. A skimmer intake guard for use in a pool or tub as described in claim 2, wherein the hook members are molded resilient and structured to grip said skimmer opening for mounting said guard thereon, wherein on the back of each hook, a small detent or bump is contained, which allows the guard hooks to be gripped by a finger, and released, so that the guard can be removed.

4. A skimmer intake guard for use in a pool or tub as described in claim 1, where the pattern of the cross-members may be equal distance, diagonal or rectangular in design.

* * * * *